US005977051A

United States Patent [19]

Dominguez, Jr.

[11] Patent Number: 5,977,051

[45] Date of Patent: Nov. 2, 1999

[54] ALCOHOL BASED NATURAL WAX CLEANING AND DUSTING COMPOSITION

[75] Inventor: Joe A. Dominguez, Jr., 12920 Marimba Trail, Austin, Tex. 78729

[73] Assignee: Joe A. Dominguez, Jr., Austin, Tex.

[21] Appl. No.: 09/002,689

[22] Filed: Jan. 5, 1998

[51] Int. Cl.[6] ..... B08B 7/00; C11D 3/43

[52] U.S. Cl. ..... 510/407; 510/432; 510/417; 510/200; 510/201; 510/205; 510/208; 510/256; 510/269; 510/338; 510/342; 510/371; 134/38

[58] Field of Search ..... 510/432, 417, 510/200, 201, 205, 208, 256, 269, 338, 342, 371, 407; 134/38

[56] References Cited

U.S. PATENT DOCUMENTS

| | | | |
|---|---|---|---|
| 3,976,588 | 8/1976 | McLaughlin | 252/117 |
| 4,129,666 | 12/1978 | Wizerkaniuk | 427/3 |
| 4,136,075 | 1/1979 | Finn et al. | 260/29.6 TA |
| 4,322,545 | 3/1982 | Scala, Jr. | 560/103 |
| 4,447,412 | 5/1984 | Bilton | 424/16 |
| 4,495,168 | 1/1985 | Schmolka | 424/45 |
| 4,539,006 | 9/1985 | Langford | 8/94.1 R |
| 4,683,001 | 7/1987 | Floyd et al. | 106/3 |
| 5,043,012 | 8/1991 | Shinohara et al. | 106/10 |
| 5,294,248 | 3/1994 | Chittofrati et al. | 106/10 |
| 5,348,736 | 9/1994 | Patel et al. | 424/70 |
| 5,512,199 | 4/1996 | Khan et al. | 252/106 |
| 5,629,006 | 5/1997 | Hoang et al. | 424/405 |

*Primary Examiner*—Yogendra Gupta
*Assistant Examiner*—Charles Boyer

[57] ABSTRACT

A cleaning and dusting composition, particularly useful as a treatment for dusting implements such as a cloth or feather duster, comprised of a high quality natural wax in an alcohol solution. In the preferred embodiment, a near-saturated solution of lanolin in denatured ethyl alcohol is employed to provide a rapidly drying, non-smear, low residue, and safe dusting treatment composition.

4 Claims, No Drawings

ALCOHOL BASED NATURAL WAX CLEANING AND DUSTING COMPOSITION

CROSS-REFERENCES TO RELATED APPLICATIONS

Not Applicable.

STATEMENT REGARDING FEDERALLY SPONSORED RESEARCH

Not Applicable.

FIELD OF THE INVENTION

This invention relates to an improved composition to assist in cleaning and dusting, and in particular to a treatment for dusting implements such as feather dusters and dusting cloths; and a treatment for furnace air filters. The new composition has superior environmental and personal exposure safety properties, good dust pick-up characteristics relative to currently available compositions, and improved usage characteristics relative to existing dusting implement treatment compositions.

DESCRIPTION OF THE RELATED ART

An object of the present invention is to provide a novel composition to assist in cleaning and dusting.

The key aspects of the composition include a rapid drying carrier to permit immediate use of a cleaning implement such as a feather duster, dust mop, or cleaning cloth; and a high-quality natural wax which attracts and holds dust, but which leaves a fine finish on the surface being cleaned or dusted.

The preferred embodiment of the composition is a nearly saturated solution of lanolin in a denatured alcohol mixture. When the composition is sprayed on a feather duster, dust mop, cleaning cloth, or air filter, the alcohol quickly evaporates and leaves a very thin coating of the lanolin on the cleaning implement.

There are several disadvantages to existing dusting and cleaning products. It is desirable or necessary to occasionally wash or otherwise clean an implement such as a feather duster, dust mop, or cleaning cloth when its surface becomes saturated with dust and dirt. When the implement is cleaned, it either loses its natural attraction to dust, or it loses the agent which was previously used to treat the implement. It is desirable to treat the implement with an agent to restore or enhance the implement's dust collection capability.

The prior art includes several types of dusting aids. The most common types are either a hydrocarbon solvent such a petroleum distillate in a carrier such as propane, isobutane, or a heavier hydrocarbon oil in a carrier. A mineral oil may be added to those compositions. The disadvantages of these types of compositions include a relatively long drying time such as an overnight delay between the application of the aid and the time that the implement can be used; a residue that might tend to cause a buildup on the surface of furniture, relatively greater environmental and personal exposure safety concerns; and a relatively low effectiveness in attracting and holding dust and dirt as compared to the current invention.

U.S. Pat. No. 5,399,282 for "Dusting and cleaning composition" which issued Mar. 21, 1995 to Kathryn E. Hansen and Luz P. Requejo describes a cleaning and dusting oil-out emulsion composition comprising an aqueous solution of paraffinic or naphthenic oil, a petroleum solvent, terpene, a glycol ether, and an emulsion system.

U.S. Pat. No. 4,414,128 to Goffinet discloses an aqueous liquid detergent composition comprising 1–20% surfactant; 0.5–10% terpene, the ratio of surfactant to terpene being 5:1 to 1:3; and 0.5–10% of a select polar solvent, which includes $C_{6-9}$alkyl ethers of ethylene glycol, the solvent having a water solubility at 25° C. of 0.2–10%.

U.S. Pat. No. 4,749,509 to Kacher claims an aqueous cleaning composition consisting essentially of 0–15% surfactant; 0.5–70% detergency builder, and 0.5–15% diethylene glycol monohexylether.

U.S. Pat. No. 4,790,951 to Frieser discloses a liquid cleaning preparation for removing the fason oil from hard surfaces of the type containing an anionic or nonionic surfactant; a water soluble builder; a water-miscible solvent; 0.25–5% of a terpene and 0.25–5% of a water insoluble polar solvent which is completely or partially hydrogenated naphthalene.

The preferred embodiment of this invention utilizes lanolin, which is a naturally occurring wax and relatively safe material which is frequently used in cosmetics or drug applications. Lanolin, or wool wax, is obtained from wool grease. It consists of about 95% esters of sterol alcohols combined with straight-chain fatty acids with small amounts of free alcohols. The fatty acids and free alcohols provide emollient properties which make lanolin useful for cosmetic applications. Proprietary derivatives of lanolin have been developed for cosmetic and other applications, and those derivatives may be used as a replacement for lanolin in this invention.

Lanolin is named in a substantial number of previous patents with uses ranging from cosmetics to fabric softening.

U.S. Pat. No. 3,933,674 to Farnsworth discloses a composition comprising 5–92% of a hydrocarbon oil of substantially the boiling range of kerosene, which is substantially free of objectionable odor and having not more than 5% sulfonatable constituents; 5–90% limonene-type citrus distillate of stated properties; 0.5–6% of a skin lubricant selected from lanolin and wool grease, and 0.5–3% of a surface active agent.

U.S. Pat. No. No. 5,507,969 for a "Cleansing-lustering agent" which issued Apr. 16, 1996 to Seigo Shinohara, Kiyoshi Okamura, and Tetsuo Kijima describes a method for cleansing and lustering a surface with an agent essentially consisting of lanolin in an oil/water emulsion composed of an emulsifying agent, a silicone oil and water. The composition creates a foamed mass on a surface. The foamed mass defoams spontaneously after a prescribed period of standing and cleanses the surface. The invention relates to a method for foaming a cleansing-lustering agent on the surface of tires such as of automobiles and bicycles. The intent of that composition is to provide a foaming cleansing-lustering agent to deposit on a surface to stand and defoam prior to cleaning, whereas in this composition, the intent is to provide a treatment to a dusting or cleaning implement.

Other naturally occurring waxes that may be used in place of lanolin include beeswax, candelilla wax, carnauba wax, cotton wax, and jojoba wax.

The lanolin or other wax may be delivered in a carrier of ethyl alcohol, methyl alcohol, isopropyl alcohol, or in a mixture of those solvents.

Although the art of cleaning and dusting compositions has been refined over many years, the present invention offers substantial improvements over prior art. One aspect of the novelty of the current invention is that it is not obvious that relatively small quantities of high quality and expensive natural waxes such as lanolin can be applied effectively to dusting implements. Commercial compositions reflect the prior art practice of employing cheaper petroleum distillates rather than natural waxes.

In this description, the examples shown include common compounds or ingredients for which those skilled in the art recognize interchange ability of other compounds or ingredients. Many other variations, modifications and applications of the illustrated embodiments of the invention will be apparent to those skilled in the art. References for the carrier component interchange ability include *Alcohols: Their Chemistry, Properties, and Manufacture* by John a. Monick, published by Reinhold Book Corporation; and the *Handbook of Chemistry and Physics* published by CRC Press. A good reference for the wax component interchange ability is the text *Chemistry and Biochemistry of Natural Waxes* edited by P. E. Olattukudy, published by Elsevier Scientific Publishing Co., 1976. Other good references for the wax component interchange ability are *Commercial Waxes, a Symposium and Compilation* and *Industrial Waxes*; both by Harry Bennett, and published by Chemical Publishing Company.

BRIEF SUMMARY OF THE INVENTION

This invention is a cleaning and dusting composition that is typically used as a treatment for feather dusters, dust mops, or cleaning cloths. The preferred embodiment presented is a nearly saturated solution of lanolin in a denatured alcohol mixture. When the composition is sprayed on a feather duster, dust mop, or cleaning cloth, the alcohol quickly evaporates and leaves a very thin coating of the lanolin on the cleaning implement. The composition offers improved time to usage, improved residue characteristics, improved cleaning effectiveness, and improved safety relative to prior art.

While not exclusive, the following describes some of the important features and objects of the present invention.

In this invention, the cleaning and dusting composition is typically packaged in a 2 ounce spray bottle that will last a typical household approximately 3–4 months. The customer can spray a small amount of the composition onto a dusting implement to improve that implement's ability to attract and hold dust. The alcohol in the composition quickly evaporates, leaving a thin coating of lanolin on the dusting implement. The implement is usually ready for use within 30 seconds after spraying the composition.

While the alcohol is a volatile organic compound, this method of dusting releases substantially less organic compound than the use of commercial compounds which are sprayed directly on the surface to be dusted. By treating the dusting implement with a relatively small amount of this composition, a customer can avoid using larger amounts of an alternative composition.

The amount of lanolin incorporated in the composition typically is in the range of 0.5% to 1.6% by weight. If the amount of lanolin added is less than the lower limit of the range specified above, the composition will still be somewhat effective, but more of the composition will typically be required to achieve the same cleaning effectiveness. If the amount exceeds the upper limit of the range, the lanolin may not stay in solution in the composition. Thus, from a practical point of view, it is particularly preferable for the lanolin content to be in the range of 1.0 to 1.4% by weight.

BRIEF DESCRIPTION OF THE DRAWINGS

Not Applicable.

DETAILED DESCRIPTION OF THE INVENTION

Example

In order to compare dusting results, applicant treated several dusting implements with the new composition and with commercially available dusting products.

A cleaning and dusting composition of approximately 1.3 % by weight of lanolin in a denatured alcohol solution was prepared. A portion of this new composition was poured into a small spray bottle.

Then, a small portion of the contents of the spray bottle was sprayed on various dusting implements including a feather duster, a dusting cloth, a dust mop and a lamb's wool duster. The amount of spray was limited to that required to provide a consistent dampness of the implement without causing a pooling of liquid on the implement. The spray appeared to dry in approximately 15 to 45 seconds depending upon the type of implement.

Similar dusting implements were treated with commercially available products according to label instructions. Many of these products required overnight drying of the dusting implements.

Surfaces of furniture, computer monitors, keyboard, glass picture frames, blinds, and automobile dashboards were then dusted with implements treated with both the new and the commercial compositions; and the surfaces were visually compared. The new composition consistently removed dust and left an attractive and shiny surface, while the commercial treatments left oily finishes on the dusted surfaces.

Tests were then performed comparing the dusting collection ability of the new composition and commercially available products including Carrosol 700 Special Dust Mop Treatment, Endust ®, Favor ®, and AVC Dust Mop Treatment. In each of these tests, the commercial products left an oily residue, and those products were not as effective in removing dust as the current invention.

DESCRIPTION OF PREFERRED EMBODIMENT

Based upon Applicants' testing, a portion of which is outlined below, the preferred embodiment of the new cleaning and dusting composition comprises a nearly saturated solution of lanolin in a denatured alcohol mixture.

The lanolin, in the form of a solid wax, is melted to a temperature of 100 to 105 degrees Farenheit and stirred in slowly to a denatured alcohol. The preferred alcohol is SLX denatured alcohol which is a commercialy available blend of 85–90% ethanol, 1–4% methanol, and 1–5% methyl isobutyl ketone. The saturation point for this composition is approximately 48 ml of the liquid lanolin in one gallon of the alcohol mixture; which is approximately a 1.5 weight % solution of lanolin. The preferred concentration is 40 ml per gallon which is 1.2 weight % solution of lanolin. It is necessary to thoroughly stir this mixture in order to get the lanolin into the solution. Once it is in solution, the lanolin has not been observed to have percipitated out of the solution.

It should be kept in kind, as one skilled in the art would understand, the appropriate amount of the lanolin will vary depending upon the particular alcohol being employed, and according to the particular grade of lanolin employed.

A small amount of food coloring may be added to the composition. This color does not provide a functional improvement to the composition.

Once the lanolin is dissolved in the alcohol mixture, it can be used immediately, or it can be stored indefinitely in a closed container.

The preferred method of delivery of the composition is in approximately 2 ounce spray bottles.

When the composition is sprayed on a feather duster, dust mop, or cleaning cloth, the alcohol quickly evaporates and leaves a very thin coating of the lanolin on the cleaning implement. The lanolin composition leaves an attractive shine on the dusted surface. The composition does not leave a residue on the cleaned surface.

The composition has been successfully applied to linen rags, cotton cloths, feather dusters, dust mops, wool dusters, and to air filters. The manufacturer's suggested method of cleaning these implements is with a detergent and water. The composition is effective in restoring or improving the dust collection capability of the implement after such a cleaning.

What is claimed is:

1. A nonaqueous cleaning and dusting solution, consisting essentially of lanolin, in a range of 0.5 to 2.5% by weight and from 97.5 to 99.5% by weight of an alcohol solution.

2. The solution of claim 1 wherein the alcohol is a denatured ethyl alcohol.

3. The solution of claim 2 wherein the alcohol is a blend of 85–90% ethanol, 1–4% methanol, and 1–5% methyl isobutyl ketone.

4. A nonaquesous cleaning and dusting solution, consisting essentially of lanolin, in a range of 0.5 to 1.5% by weight in a denatured alcohol solution.

* * * * *